US009427857B2

(12) United States Patent
Kok

(10) Patent No.: US 9,427,857 B2
(45) Date of Patent: Aug. 30, 2016

(54) NAILER

(71) Applicant: King Wong Kevin Kok, Hongkong (CN)

(72) Inventor: King Wong Kevin Kok, Hongkong (CN)

( * ) Notice: Subject to any disclaimer, the term of this patent is extended or adjusted under 35 U.S.C. 154(b) by 462 days.

(21) Appl. No.: 14/150,777

(22) Filed: Jan. 9, 2014

(65) Prior Publication Data

US 2014/0197221 A1 Jul. 17, 2014

(30) Foreign Application Priority Data

Jan. 17, 2013 (CN) ..... 2013 2 0025353 U

(51) Int. Cl.
*B25C 1/08* (2006.01)
*B25C 1/04* (2006.01)
*B25C 1/00* (2006.01)

(52) U.S. Cl.
CPC ..... *B25C 1/08* (2013.01); *B25C 1/008* (2013.01); *B25C 1/04* (2013.01)

(58) Field of Classification Search
CPC ..... B25C 1/08; B25C 1/003; B25C 1/008; B25C 1/04; B25C 1/041; B25C 1/044; B25C 1/046; B25C 1/047; B25C 1/06; B25C 1/10; B25C 1/188; B25C 7/00; B25C 7/02
USPC ..... 227/8, 10, 120, 130, 136, 142, 109
See application file for complete search history.

(56) References Cited

U.S. PATENT DOCUMENTS 5,219,110 A * 6/1993 Mukoyama ..... B25C 1/008 227/142
5,385,286 A * 1/1995 Johnson, Jr. ..... B25C 1/047 227/142
5,839,638 A * 11/1998 Ronn ..... B25C 1/008 227/120
6,170,729 B1 * 1/2001 Lin ..... B25C 1/008 227/142
6,851,595 B1 * 2/2005 Lee ..... B25C 1/008 227/142
7,318,546 B2 * 1/2008 Segura ..... B25C 1/008 227/130
7,413,103 B1 * 8/2008 Ho ..... B25C 1/008 227/120
7,721,927 B2 * 5/2010 Osuga ..... B25C 1/08 123/46 SC
7,753,243 B2 * 7/2010 Brendel ..... B25C 1/008 227/119
8,453,902 B2 * 6/2013 Jang ..... B25C 1/008 227/142
8,499,991 B2 * 8/2013 Spasov ..... B25C 1/003 227/131
8,550,324 B2 * 10/2013 Coleman ..... B25C 1/008 227/142

* cited by examiner

*Primary Examiner* — Scott A. Smith

(57) ABSTRACT

A nailer includes a housing, a handle connecting the housing, a combustion chamber and a cylinder inside the housing, a piston whose rear end is inside the cylinder, a cage covering the exterior front end of the cylinder with the front end abutting on that of the cylinder, and a pin guide component that separately connects the nailer and further includes a nose piece, a guide sleeve whose lower end links the pin guide, an adjusting threaded rod whose front end connects the upper end of the guide sleeve and rear end links the upper end of the rear sleeve, a knob, a rear sleeve inserted into the adjusting threaded rod and fixed between the upper end of the guide sleeve and that of the rear sleeve, and a piston guide. The nailer boasts capability of pin guide replacement, quick troubleshooting and regulation of the nail driving depth.

5 Claims, 7 Drawing Sheets

NAILER

BACKGROUND OF THE PRESENT INVENTION

1. Field of Invention

The present invention relates to a nailer, and more particularly, to a new nailer with elements adjusting nail driving depth and facilitating quick troubleshooting.

2. Description of Related Arts

Currently, a nailer is a type of tool widely used in industries, such as construction and decoration. Commonly-seen nailers generally have a single function. For instance, the nail guide assembly cannot be dismantled and replaced with other types of nail pipes for realizing different functions and applications; the pin guide component and the track cannot be dismantled for quick troubleshooting; or the pin guide cannot be adjusted forwards or backwards to cater different requirement on the driving depth. All these will cause inconvenience in use of the nailers.

SUMMARY OF THE PRESENT INVENTION

For the abovementioned reasons, the purpose of the present invention is to provide a new nailer with elements adjusting nail driving depth and facilitating quick troubleshooting.

A new nailer, comprises a housing, a handle that connects the housing, an combustion chamber and a cylinder inside the housing, a piston whose rear end is located inside the cylinder, a cage that covers the exterior front end of the cylinder, with the front end abutting on that of the cylinder, wherein the combustion chamber wraps the exterior rear end of the cylinder, and the rear end of the cage is connected with the front end of the combustion chamber, a head cover positioned on the rear end of the housing, a cylinder head on the rear end of the cylinder, an O-ring inside the cylinder, a nose piece connected with the front end of the housing, a pin guide whose rear end is inside the guide sleeve, and a track assembly below the guide sleeve that connects with it, a pin guide component that can separately connect the nailer, which comprises a pin guide, a guide sleeve, a nose piece, an adjusting threaded rod, a knob, a rear sleeve and a piston guide, wherein the lower end of the guide sleeve is linked with the pin guide; the front end of the adjusting threaded rod is connected with the upper end of the guide sleeve while its rear end is linked with the upper end of the rear sleeve; the knob is inserted into the adjusting threaded rod and is fixed between the upper end of the guide sleeve and that of the rear sleeve, the rear end of the rear sleeve is positioned at the top of the rear end of pin guide and abuts on the front end of the cage; the front end of the piston guide is inside the rear sleeve while its lower rear end connects the pin guide.

Furthermore, two semicircular tanks are below the guide sleeve and the rear sleeve respectively. The guide sleeve is provided with two annular bosses. The lower end of the guide sleeve connects the segment of the pin guide between the two annular bosses. An arc boss is fixed below the rear end of the piston guide, which matches with a square hole on the nose piece.

A nail feeder is set above the track assembly, which includes a pin-free contact, a nail pushing head and a perforated stud.

The nailer further comprises a connection component for installation of the track assembly, which comprises a connection plate holder, a connection plate, a hook, a connection plate cover, a wrench, a washer, a guide rail lock and a torsional spring. The connection plate mounted on the handle is provided with a first and second hole. The connection plate holder is provided with a first and second screw column that corresponds to the first and second hole. The first screw column goes through the first hole, the hook, the connection plate cover and the wrench in sequence, and become fixed via the fastener and the washer. The second screw column goes through the second hole, the track lock and the connection plate cover in sequence, and become fixed via the fastener and the washer. The torsional spring nests the track lock, with one claw suspended on the track lock and the other claw on the hook.

The hook has a hook portion which abuts on a concave tooth of the track lock. The semicircular buckle of the guide rail buckle meshes with a semicircular notch of the track lock.

The favorable effects of the present invention: when the adjusting screw nut is rotated to separate the knob from the guide sleeve, the pin guide can be dismantled and replaced by other types of pin guides; as to failures like nail jamming, after the dismantlement of the track assembly through the connection component, the nail pipe is demounted and the nail stuck is removed, thus leading to quick troubleshooting; the adjusting threaded nut is rotated to change the total length of the pin guide and the guide sleeve, adjusting nail driving depth.

DETAILED DESCRIPTION OF THE PREFERRED EMBODIMENT

For a better understanding for those skilled in this art, the present invention is further detailed by the embodiments in combination with the drawings as below.

The nail driving direction of the nailer in the embodiments is uniformly defined as forward.

Figure 1:
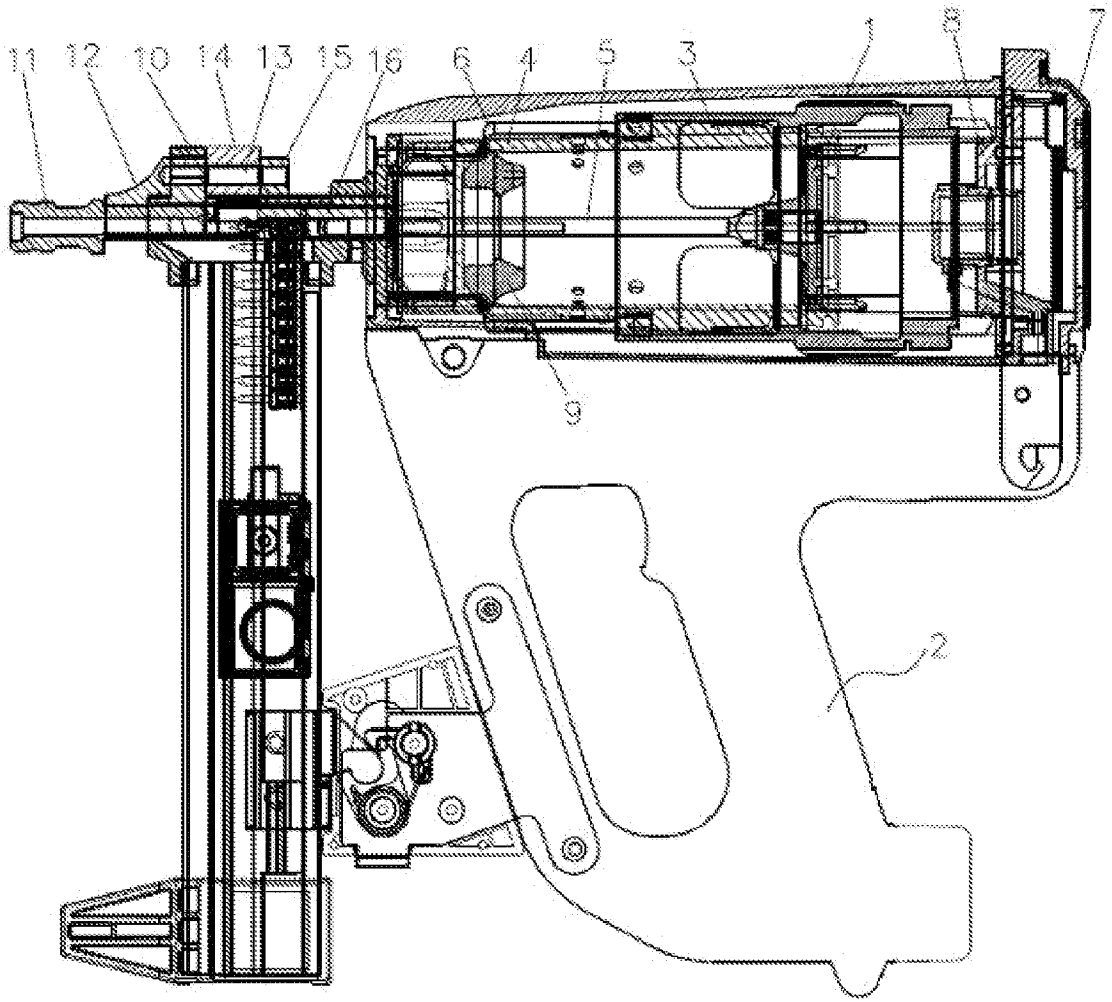
FIG. 1 is the sectional view of the present invention seen in a certain angle.
Figure 2:
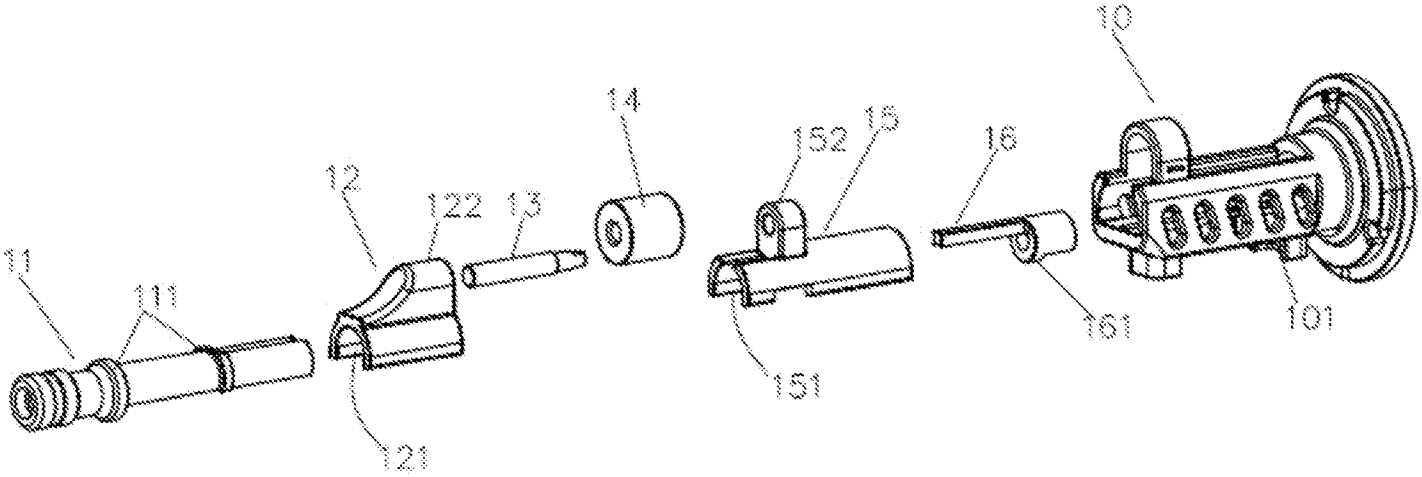
FIG. 2 is the exploded view of the pin guide component in the present invention.

As shown in FIGS. 1-2, a new nailer comprises a housing 1, a handle 2 that connects the housing, an combustion chamber 3 and a cylinder head 4 inside the housing, a piston 5 whose rear end is located inside the cylinder head 4, a cage 6 that covers the exterior front end of the cylinder head 4, with the front end abutting on that of the cylinder, wherein the combustion chamber 3 wraps the exterior rear end of the cylinder, and the rear end of the cage 6 is connected with the front end of the combustion chamber 3, thus the connection and disconnection between the combustion chamber 3 and the cylinder head 4 can be controlled, a head cover 7 positioned on the rear end of the housing, a cylinder head 8 on the rear end of the cylinder, a bumper 9 inside the cylinder; a nail nose piece 10 connected with the front end of the housing, a pin guide 11 whose rear end is inside the guide sleeve, and a track assembly below the nose piece 10 that connects with it.

The nailer further comprises a guide sleeve 12, an adjusting threaded rod 13, a knob 14, a rear sleeve 15 and a piston guide 16. Two semicircular tanks 121 and 151 are below the guide sleeve 12 and the rear sleeve 15 respectively. The pin guide 11 is provided with two annular bosses 111. The lower end of the guide sleeve 12 connects the segment of the guide sleeve 11 between the two annular bosses 111. An arc boss 161 is fixed below the rear end of the piston guide 16, which matches a square hole 101 on the nose piece 10.

The front end of the adjusting threaded rod 13 is connected with the upper end 122 of the regulator while its rear end is linked with the upper end 152 of the sleeve. The knob 14 is inserted into the adjusting threaded rod 13 and located between the upper end 122 of the regulator and the upper end 152 of the sleeve. The rear end of the rear sleeve 15 is positioned inside the rear end of the nose piece 10 and abuts on the front end of the cage 6.

As shown in FIG. 2, the nail guide components comprise the nose piece 10, the pin guide 11 whose rear end is inside the guide sleeve, the guide sleeve 12, the threaded screw rod 13, the knob 14, the rear sleeve 15 and the piston guide 16. The order to install them is as follows. The piston guide 16 is installed firstly, with its arc boss 161 fitting into the square hole 101 that is interlinked with the inner cavity of the nose piece 10. The rear sleeve 15 is slide into the pin guide. The semicircular tank 121 at the bottom of the guide sleeve is fixed on the segment of the pin guide 11 between the two annular bosses 111, and the finished part as a whole is slide into the nose piece 10. The connection portion of the adjusting threaded rod 13 and the upper end 152 of the sleeve is screwed on the driver by the adjusting threaded nut 14. Therefore, the nail guide component is formed. If the nail guide component needs to be dismantled, this can be done in reverse order, so as to clean or remove failures.

Figure 3:
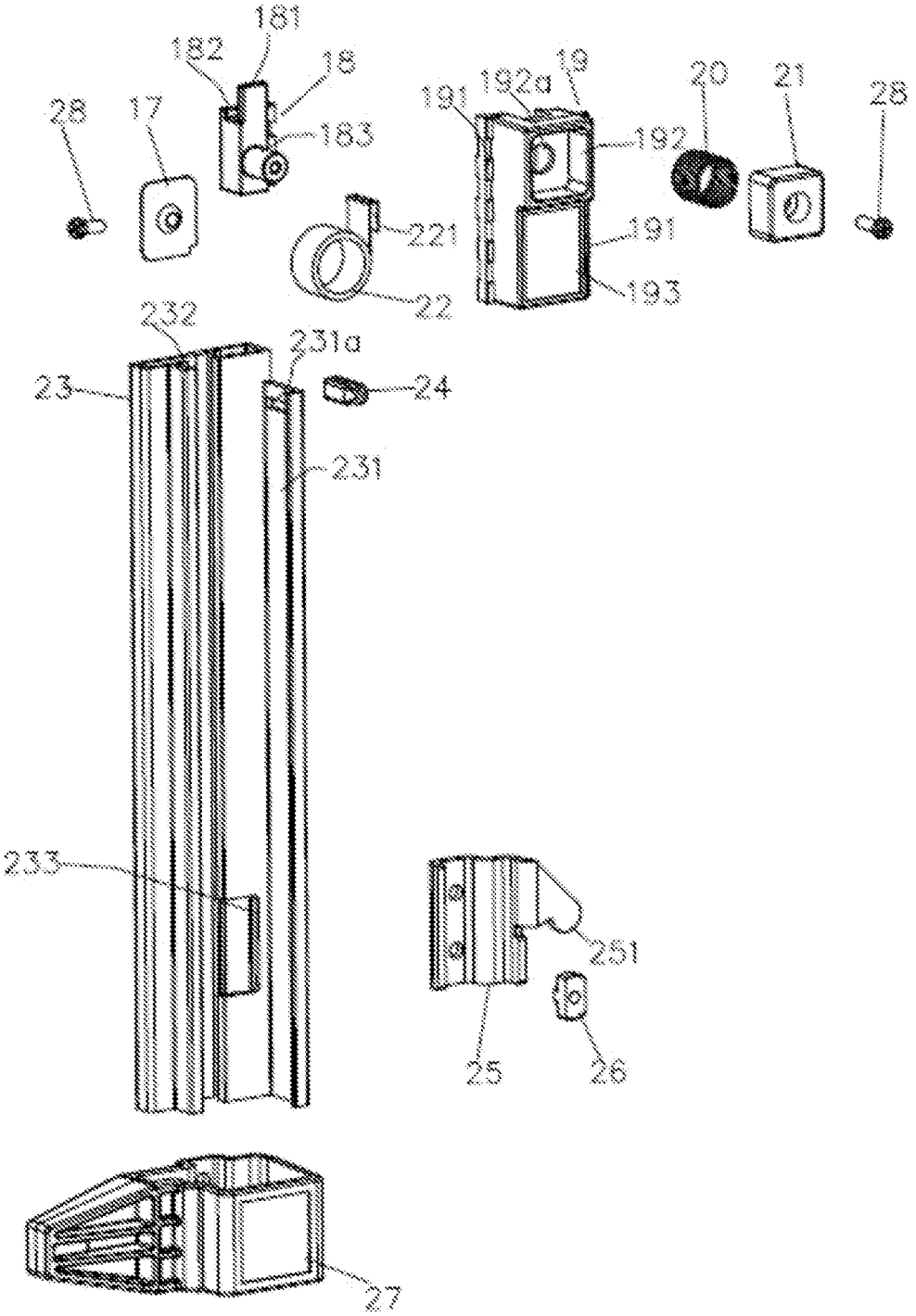
FIG. 3 is the exploded view of the track assembly in the present invention.

As shown in FIG. 3, the track assembly includes a pinch plate 17, a nail feeder 18, a nail feeding support 19, a spring 20, a nail feeding button 21, a coil spring 22, a track 23, a rubber stopper 24, a track connector 25, a track nut 26 and a track cap 27.

The track 23 is provided with a first sliding chute 231 and a second sliding chute 232. Lugs 191 are set on both sides of the nail feeding support 19 to match with the first and second sliding chutes. A first notch 231*a* is made on the upper end of the back panel of the first sliding chute, in which a hanger 221 of the coil spring 22 is suspended and one end of the rubber stopper 24 is located. A second notch 233 is made on the back panel that is vertical to the back panel of the first sliding chute, which is diagonally below the first notch 231*a*.

The track connector 25, which is bolted on the track 23, is provided with a semicircular buckle 251. The track cap 27 is set below the track 23.

The nail feeder 18 includes a pin-free contact 181, a nail pushing head 182 and a perforated stud 183. The nail feeding support 19 is provided with an upper receiving cavity 192 and a lower receiving cavity 193, with a round hole 192*a* on the back panel of the upper receiving cavity 192. The perforated stud 183 goes through the round hole 192*a* to be positioned inside the upper receiving cavity 192. The spring 20 nests the perforated stud 183, on which the nail feeding button 21 is fixed by a fastener 28 (e.g. screw). The coil spring 22 is positioned inside the lower receiving cavity 193 through the pinch plate 17 and the fastener 28 (e.g. screw).

Figure 4:
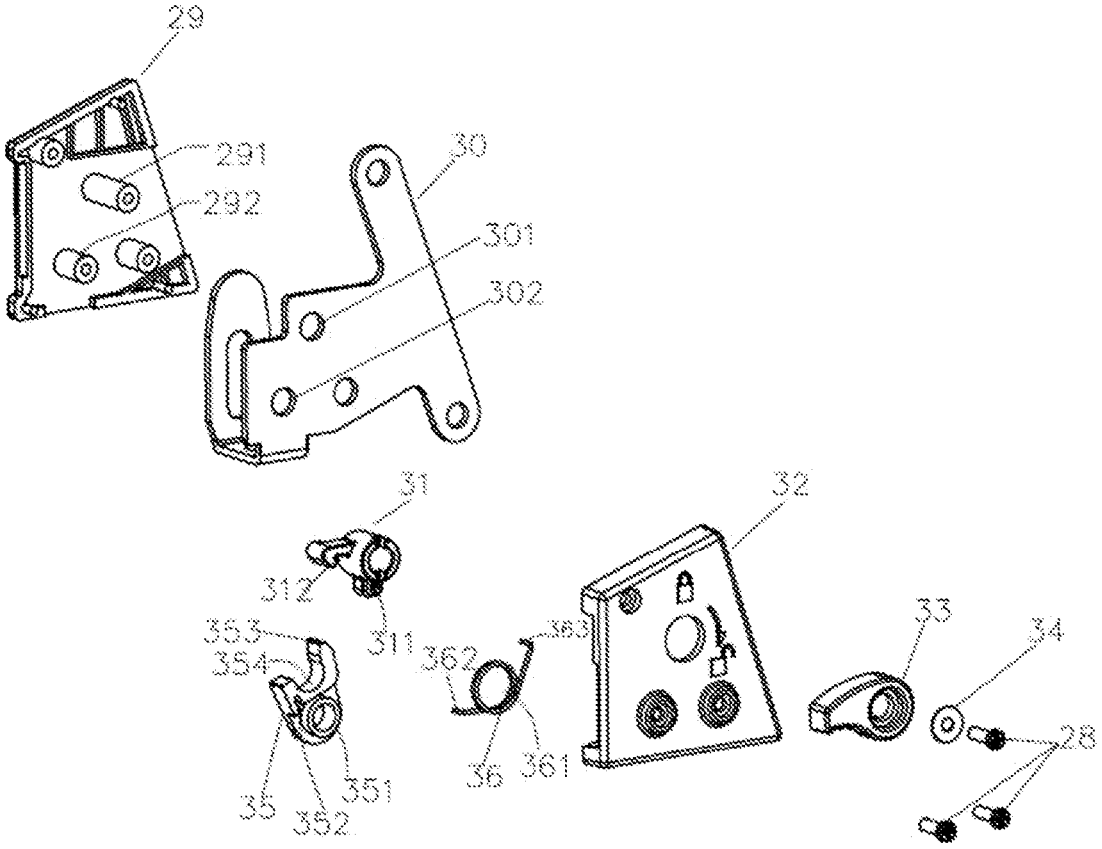
FIG. 4 is the exploded view of the connection component in the present invention.

As shown in FIG. 4, the nailer further comprises a connection component for installation of the guide rail assembly, which comprises a connection plate holder 29, a connection plate 30, a hook 31, a connection plate cover 32, a wrench 33, a washer 34, a guide rail lock 35 and a torsional spring 36. The connection plate 30 mounted on the handle 2 is provided with a first and second hole 301 and 302. The connection plate holder 29 is provided with a first and second screw column 291 and 292 that correspond to the first and second hole. The first screw column 291 goes through the first hole 301, the hook 31, the connection plate cover 32 and the wrench 33 in sequence, and become fixed via the fastener 28 (e.g. screw) and the washer 34. The first and second screw column 292 goes through the second assembling hole 302, the track lock 35 and the connection plate cover 32 in sequence, and become fixed via the fastener 28 and the washer 34. A ring body 361 on the torsional spring nests a column 351, with one claw 362 suspended on the long and narrow notch 352 of the track lock and the other claw 363 on a strip-shaped hole 311 of the hook.

The hook 31 has a hook portion 312 which abuts on a concave tooth 353 of the track lock 35. The semicircular buckle 251 of the track connector 25 meshes with a semicircular notch 354 of the track lock 35.

Figure 5:
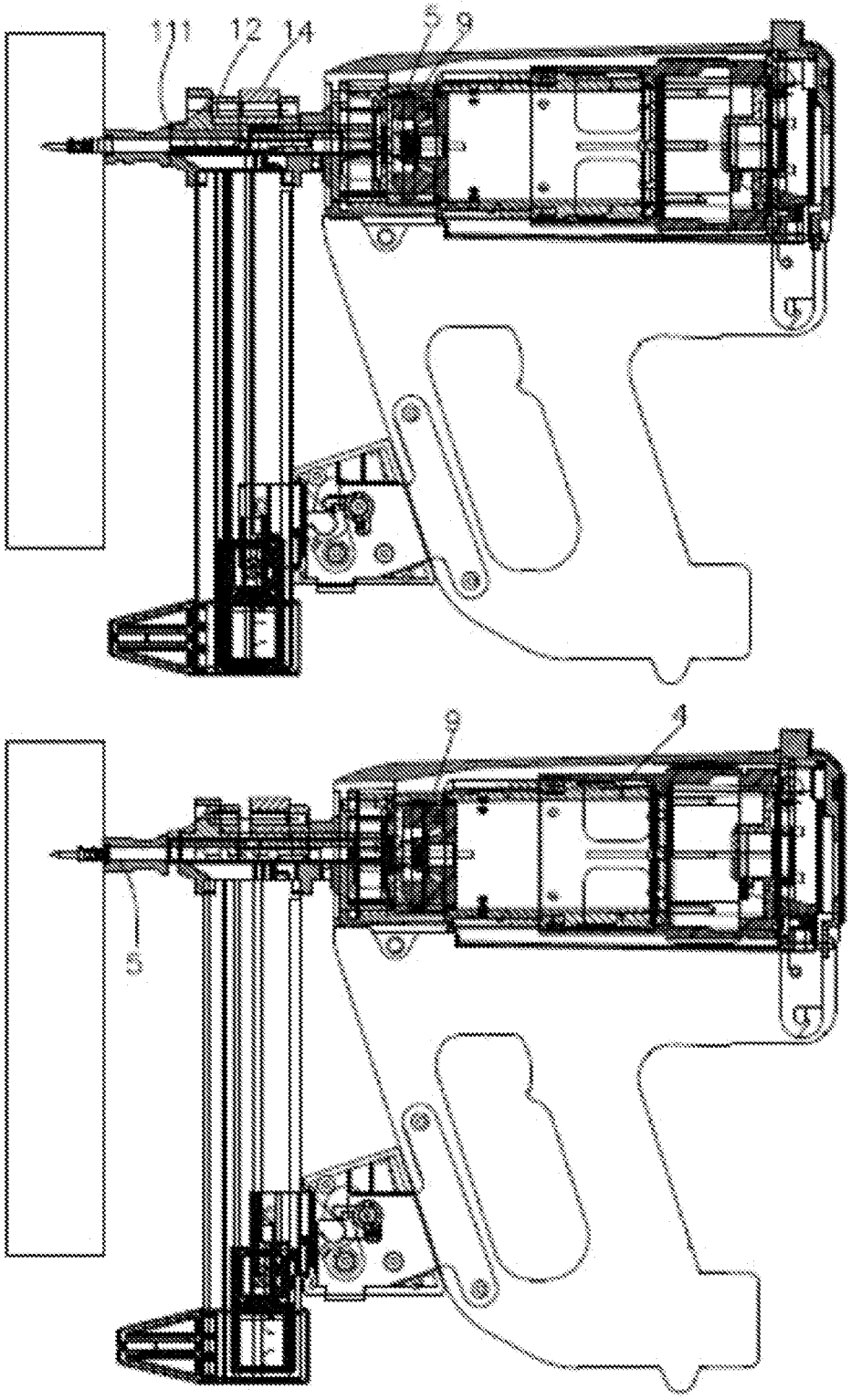
FIG. 5 is the schematic view of the comparison of different nail driving depths in the present invention.

FIG. 5 shows a method to adjust the nailing depth. The adjusting threaded nut 14 can be rotated to allow the contact end of the guide sleeve 12 and the pin guide 11 to abut on the annular boss 111 of the pin guide 11, so the total length of the pin guide 11 and the nose piece 10 increases, leading to shallow nail driving depth into base material. The piston 5 is pushed out by the high temperature and pressure in the cylinder head 4 and is stopped when hitting against the bumper 9. Consequently, nailing depth is controlled. On the contrary, if deep nail driving is in need, the adjusting threaded nut 14 is rotated in reverse direction to allow the total length of the pin guide 11 and the nose piece 10 to decrease, leading to deeper nail driving.

Figure 6:
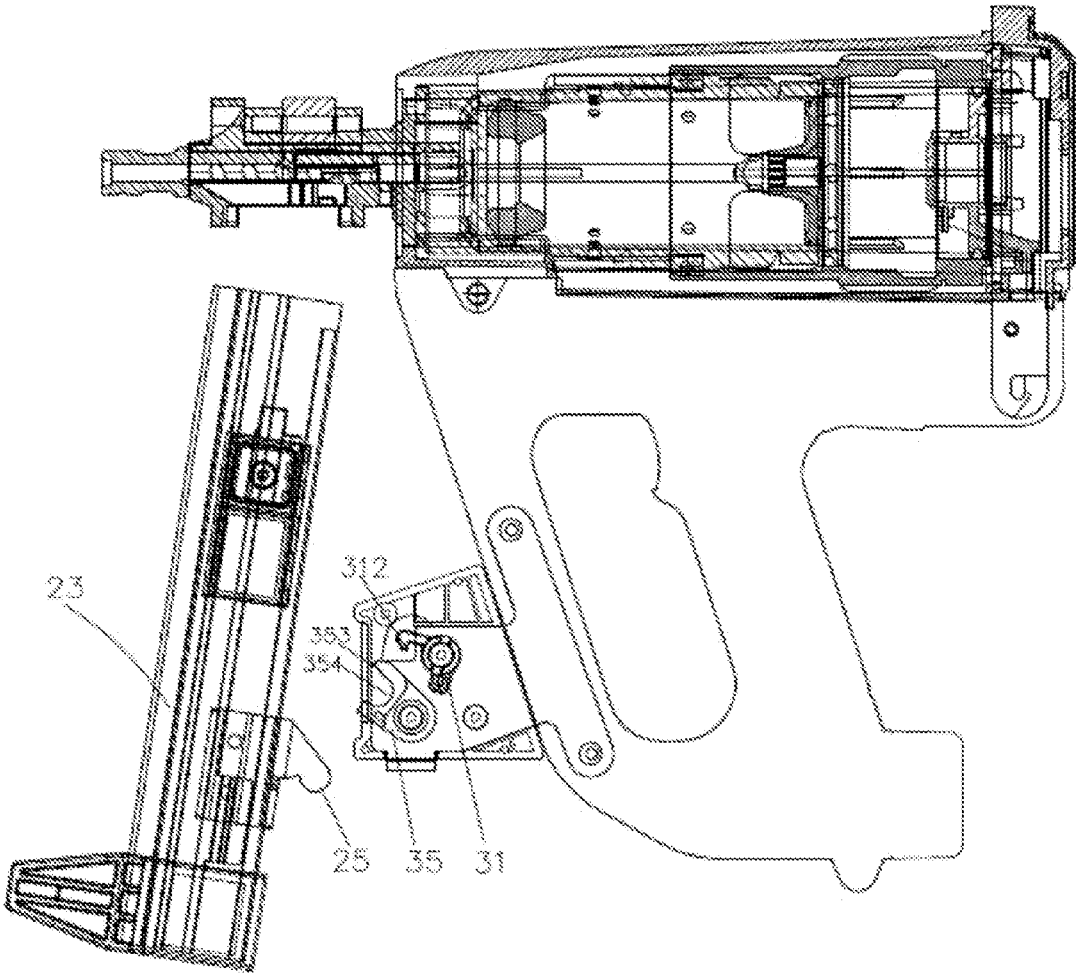
FIG. 6 is the schematic view of the installation and dismantlement of the track assembly in the present invention.

As shown in FIG. 6, for dismantlement of the track assembly, the wrench 33 is switched clockwise, which results in clockwise rotation of the hook 31. Therefore, the hook portion 312 of the hook 31 separates from the concave tooth 353 of the track lock 35, which rotates anticlockwise because of the torsional spring 36 and disconnects with the track connector 25, leading to dismantlement of the track assembly. The end of the track 23 is inserted into the grooved body of the nose piece 10. The semicircular buckle 251 of the track connector 25 meshes with the semicircular notch 354 of the track lock 35, during which the hook portion 312 of the hook 31 is pushed out automatically and then hooks up the concave tooth 353 of the guide rail lock, thus locking up the track 23.

Figure 7:
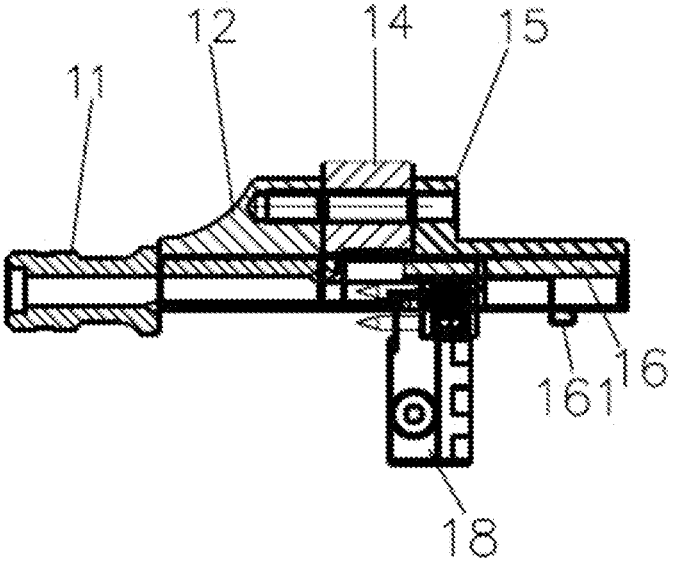
FIG. 7 is the schematic view of the connection between the piston guide and the pin guide in the present invention.

As shown in FIG. 7, as the piston guide 16 is embedded into the square hole 101 of the nose piece 10 via the arc boss 161, the piston guide 16 has no displacement to the right or left relative to the nose piece 10. As a result, the front end of the piston guide 16 always blocks the way of the topmost nail during nail driving, generating supporting force that forms balance force with the upward thrust producing by the nail feeder 18. When the last nail on the nailing strip enters into the pin guide 11, it will not move as the pin guide does under the action of the balance force. So the topmost nail cannot be driven out by the piston. If there are two or more than two nails, movement of the nailing strip will be restricted by a square passage below the nail guide 10.

Although the present invention is described in combination with embodiments, those skilled in the art shall know that any modifications and variations can be made without departing from the spirit of the present invention. Therefore, the spirit of present invention is subject to the claims.

What is claimed is:

1. A nailer, comprising a housing, a handle that connects to the housing, a combustion chamber and a cylinder inside the housing, a piston whose rear end is located inside the cylinder, a cage that covers an exterior front end of the cylinder, with a front end abutting the cylinder, wherein the combustion chamber wraps around an exterior rear end of the cylinder, and a rear end of the cage is connected with a front end of the combustion chamber, a rear cap positioned on a rear end of the housing, a cylinder head on the rear end of the cylinder, an O-ring inside the cylinder, a nose piece connected with a front end of the housing, a pin guide whose rear end is inside the nose piece, and a track assembly located below and connected with the nose piece, characterized in that the nailer further comprises a pin guide component that can separately connect to the nailer and comprises a pin guide, a nose piece, a guide sleeve, an adjusting threaded rod, a knob, a rear sleeve and a piston guide, wherein a lower end of the guide sleeve is linked with the pin guide; a front end of the adjusting threaded rod is connected with an upper end of the guide sleeve while a rear end of the adjusting threaded rod is linked with an upper end of the rear sleeve; the knob is inserted into the adjusting threaded rod and is fixed between the upper end of the guide sleeve and that of the rear sleeve; a bottom end of the rear sleeve is positioned at a rear end of the pin guide and abuts on the front end of the cage; a front end of the piston guide is inside the rear sleeve while a bottom rear end of the piston guide connects the cage.

2. The nailer as claimed in claim 1, characterized in that two semicircular tanks are below the guide sleeve and the rear sleeve respectively; the pin guide is provided with two annular bosses; the lower end of the guide sleeve connects a segment of the pin guide between the two annular bosses; an arc boss is fixed below the rear end of the piston guide, which matches with a square hole on the nose piece.

3. The nailer as claimed in claim 1, characterized in that a nail feeder is set above the track assembly, which comprises a pin-free contact, a nail pushing head and a perforated stud.

4. The nailer as claimed in claim 1, characterized in that the nailer further comprises a connection component for installation of the track assembly, which comprises a connection plate holder, a connection plate, a hook, a connection plate cover, a wrench, a washer, a track lock and a torsional spring; the connection plate mounted on the handle is provided with a first and second hole; the connection plate holder is provided with a first and second screw column that corresponds to the first and second hole; the first screw column goes through the first hole, the hook, the connection plate cover and the wrench in sequence, and become fixed via the fastener and the washer; the second screw column goes through the second hole, the track lock and the connection plate cover in sequence, and become fixed via the fastener and the washer; the torsional spring nests the track lock, with one claw suspended on the track lock and the other claw on the hook.

5. The nailer as claimed in claim 4, characterized in that the hook has a hook portion which abuts on a concave tooth of the track lock; a semicircular buckle of a track connector meshes with a semicircular notch of the track lock.

* * * * *